United States Patent [19]

Almström et al.

[11] Patent Number: 4,457,133

[45] Date of Patent: Jul. 3, 1984

[54] METHOD OF GOVERNING THE WORKING GAS TEMPERATURE OF A SOLAR HEATED HOT GAS ENGINE

[75] Inventors: Sten-Håkan Almström, Lund; Hans G. Nelving, Höllviksnäs, both of Sweden

[73] Assignee: United Stirling AB, Malmo, Sweden

[21] Appl. No.: 287,873

[22] Filed: Jul. 29, 1981

[51] Int. Cl.[3] ..... F02G 1/06

[52] U.S. Cl. ..... 60/524; 60/521; 60/641.8; 290/40 C

[58] Field of Search ..... 60/517, 521, 524, 641.8; 290/40 R, 40 C

[56] References Cited

U.S. PATENT DOCUMENTS

| | | | |
|---|---|---|---|
| 3,397,533 | 8/1968 | Steiner et al. | 60/524 X |
| 3,859,794 | 1/1975 | Hakansson | 60/524 |
| 3,999,388 | 12/1976 | Nystrom | 60/521 |
| 4,236,383 | 12/1980 | Selcuk | 60/524 X |

OTHER PUBLICATIONS

Bratt et al., "The Stirling Engine–A Ready Candidate for Solar Thermal Power," S.A.E. Technical Paper, presented at the International Congress and Exposition, Detroit, MI, Feb. 23–27, 1981.

NASA, Design Study of a Kinematic Stirling Engine for Dispersed Solar Electric Power Systems, DOE/-NASA/0056-79/2; NASA CR-159588; 1980 Final Report.

*Primary Examiner*—Allen M. Ostrager
*Assistant Examiner*—Stephen F. Husar
*Attorney, Agent, or Firm*—Finnegan, Henderson, Farabow, Garrett & Dunner

[57] ABSTRACT

A closed-cycle hot gas engine heated by solar radiation is provided with a governing system varying the working gas pressure so as to vary the power output at a constant high temperature level of the working gas and—at least partly—at a constant engine speed.

7 Claims, 7 Drawing Figures

METHOD OF GOVERNING THE WORKING GAS TEMPERATURE OF A SOLAR HEATED HOT GAS ENGINE

This invention relates to a method of governing the working gas temperature of a solar heated hot gas engine.

BACKGROUND OF THE INVENTION

Hot gas engines are generally heated by fossil fuel burned with air. For example, the combustion air mass flow may be supplied in dependence in the temperature of the heater head of the engine and the fuel mass flow may be governed in proportion to the supplied mass flow of air. Such control system will cause a constant temperature of the working gas in the high temperature variable volume chambers of the engine. The U.S. Pat. No. 3,859,794 shows an engine provided with such system.

A closed-cycle hot gas engine is very suitable for being solar heated as the working cycle is completely independent of the kind of heat source used. However, it is essential that the working gas temperature is governed so as to provide maximum efficiency of the engine in order to generate maximum power at a specific solar plant.

OBJECT AND SUMMARY OF THE INVENTION

It is an object of the invention to provide a method of governing the working gas temperature of a solar heated, closed-cycle hot gas engine so as to maintain maximum efficiency at any power output and this is according to the invention obtained by keeping the engine speed constant during at least a part of a power output range and concurrently varying the working gas pressure so as to maintain a constant working gas temperature.

DETAILED DESCRIPTION

Figure 1:
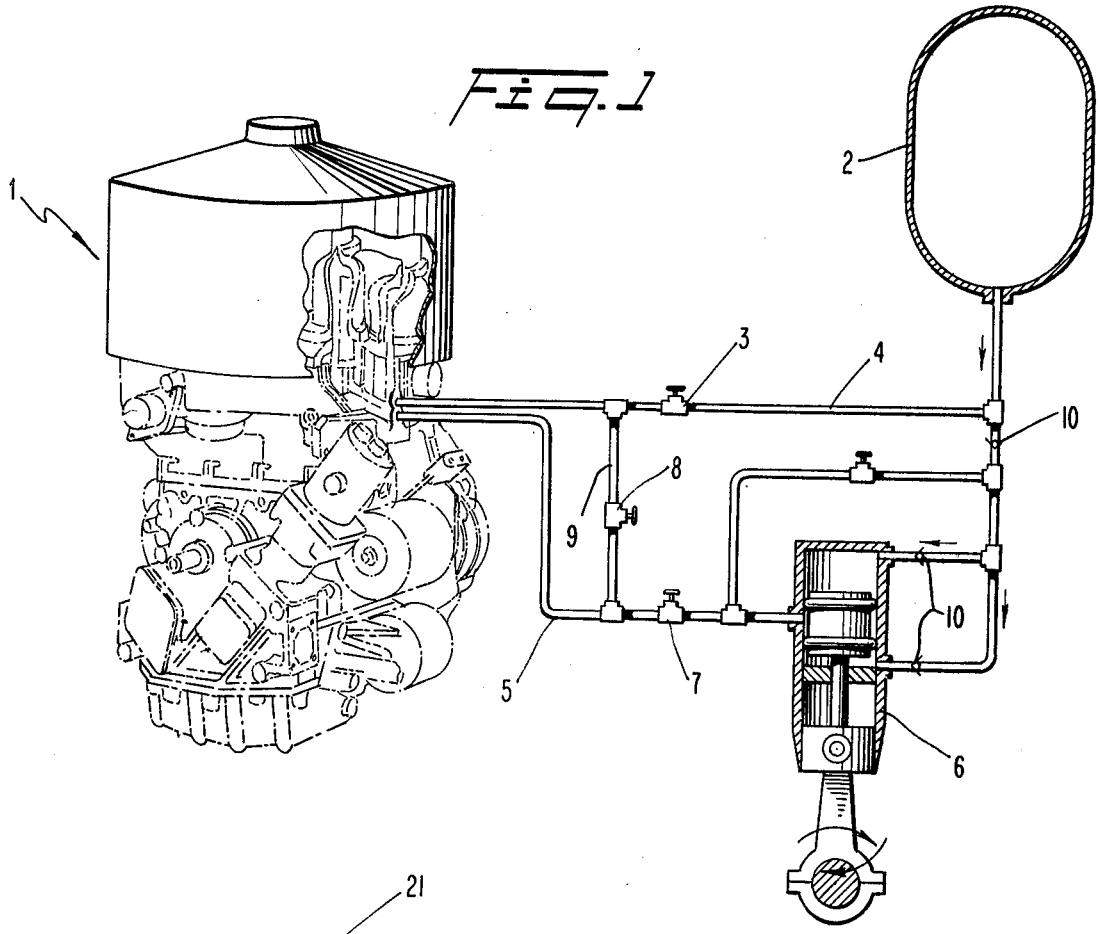
FIG. 1 shows a working gas pressure control system for a hot gas engine of known design.

Referring first to FIG. 1, a hot gas, closed-cycle engine of known design (e.g. of the type shown in U.S. Pat. No. 4,195,554) has been designated generally by the reference numeral 1.

Working gas—e.g. helium or hydrogen—to be used in the engine variable volume chambers may be supplied from a reservoir 2, a supply valve 3 being mounted in a pipe connection 4 between the engine 1 and the reservoir 2. A further pipe connection 5 between the engine 1 and the reservoir 2 contains a compressor 6 and a dump valve 7. The compressor 6 is driven from the crank shaft of the engine 1 and its suction side is connected to the engine 1 while its delivery side is connected to the reservoir 2. A by-pass valve 8 is arranged in a connection 9 between the supply pipe connection 4 and the dump pipe connection 5.

The working gas pressure control system shown in FIG. 1 is known per se and operates as follows:

In case the power output of the engine should be increased the working gas pressure is raised by opening the supply valve 3. Gas will now flow from the reservoir 2 into the variable volume chambers of the engine. As soon as the pressure has reached the desired level the valve 3 is closed.

If the working gas pressure should be reduced, the dump valve 7 is opened. The compressor 6 will now pump gas from the engine into the reservoir 2.

If the power output of the engine should be reduced instantly the by-pass valve 8 is opened in addition to the opening of the valve 7. Check valves 10 govern the gas flow through the compressor 6.

Figure 2:
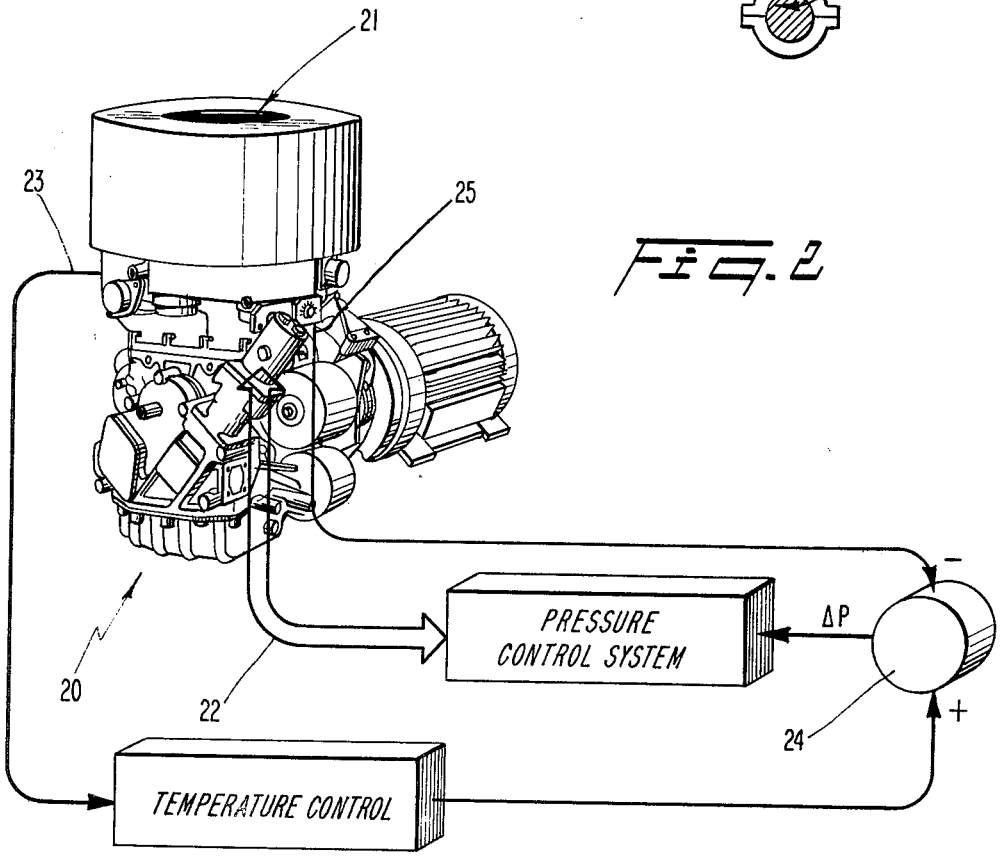
FIG. 2 is a block diagram of a control system for a solar powered hot gas engine adapted to generate electric AC power supplied to an existing AC grid.

FIG. 2 shows a hot gas engine 20 adapted to be heated by solar radiation supplied through an aperture 21. The engine control system comprises a pressure control system of the type shown in FIG. 1 governing flows of working gas to and from the engine 20 via ducts designated by 22. The solar radiation will heat the high temperature variable volume chambers of the engine and the temperature is measured by a thermo-couple 23. The signal from said thermo-couple is compared with a desired temperature in a temperature control. The difference between the actual and the desired temperature will cause a signal which is fed to a summator 24. A pressure sensor 25 will register the gas pressure in the engine and give a corresponding signal to the summator 24. The summator 24 will govern the pressure control system as described below, reference also being made to FIGS. 3 and 4.

The solar radiation is directed through the aperture 21 by means of mirrors (not shown). The energy thus supplied will vary in dependence on the intensity of the solar radiation. The efficiency of the engine increases with the temperature of the working gas in the high temperature variable volume engine chambers and thus it is desired to maintain a high temperature level determined by a reasonable life time of the parts of the engine exposed to high temperatures.

Figure 3:
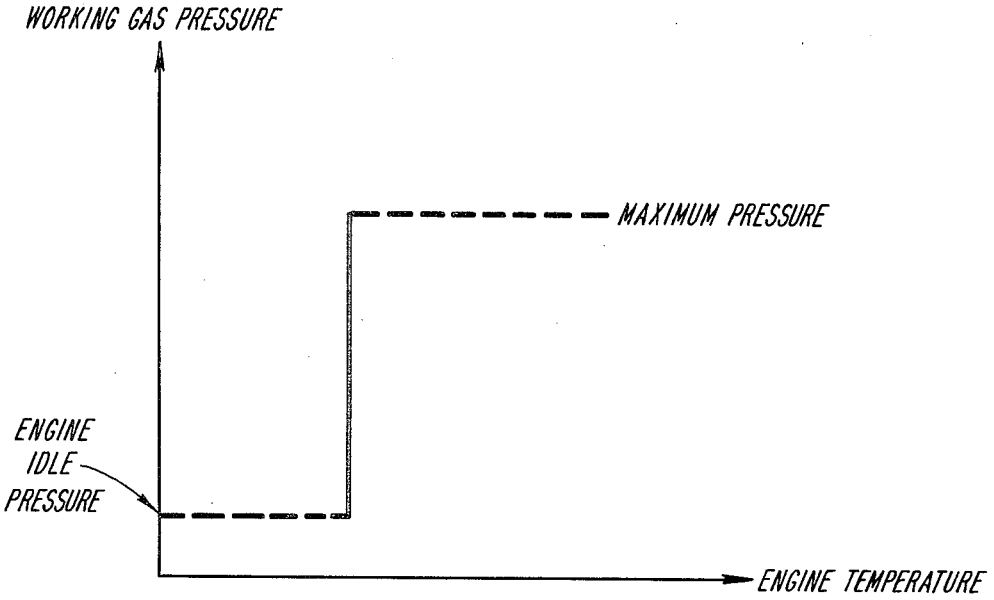
FIG. 3 is a graph of the pressure of the working gas as a function of the high level engine temperature.

At low solar energy supply the gas pressure in the engine is kept at a low level—the engine idle pressure—as shown in FIG. 3. As soon as a certain temperature (only slightly below the upper temperature limit) is reached the engine will be able to produce power at said engine idle pressure. With increasing solar radiation input the engine temperature is kept almost constant while the working gas pressure is raised until the maximum pressure is obtained. A further increase in solar energy input will cause an increase in engine temperature as shown in dotted lines, but such increase is not desirable and the mirror governing (not shown) will generally not allow such high energy input.

Figure 4:
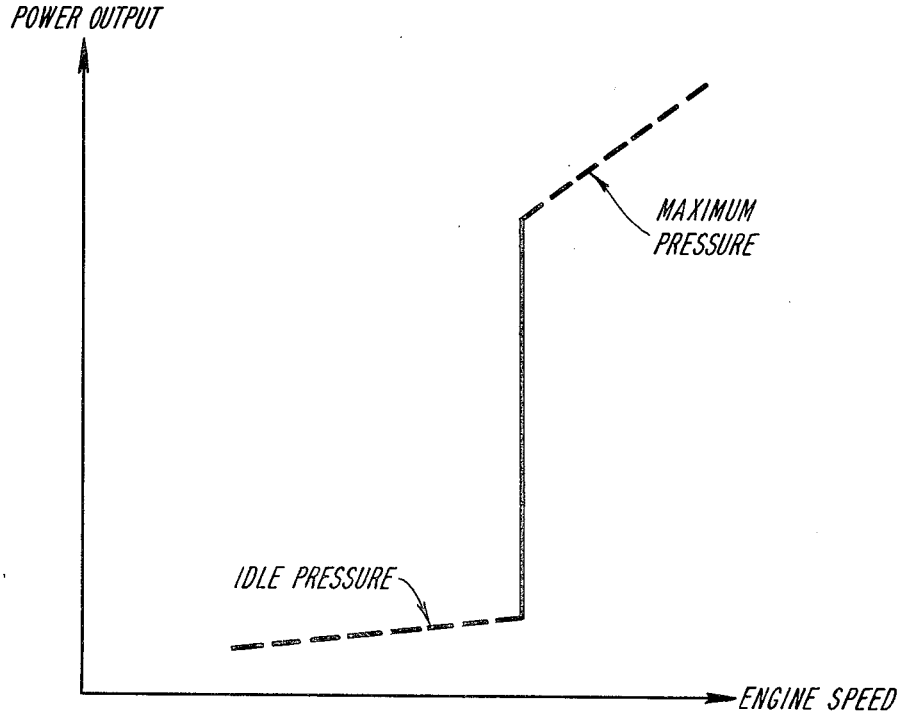
FIG. 4 is a graph of the power output as a function of the engine speed in a plant having the control system of FIG. 2.

FIG. 4—in fully drawn line—shows the power output as a function of the engine speed. As the generator is of AC type connected to an existing grid the engine speed is constant at all loads. The curves in dotted lines show engine performance at idle pressure and at maximum gas pressure.

The summator 24 shown in FIG. 2 will govern the pressure control system so as to maintain the temperature of the hot working gas charges at a constant level within a wide range of engine power output.

Figure 5:
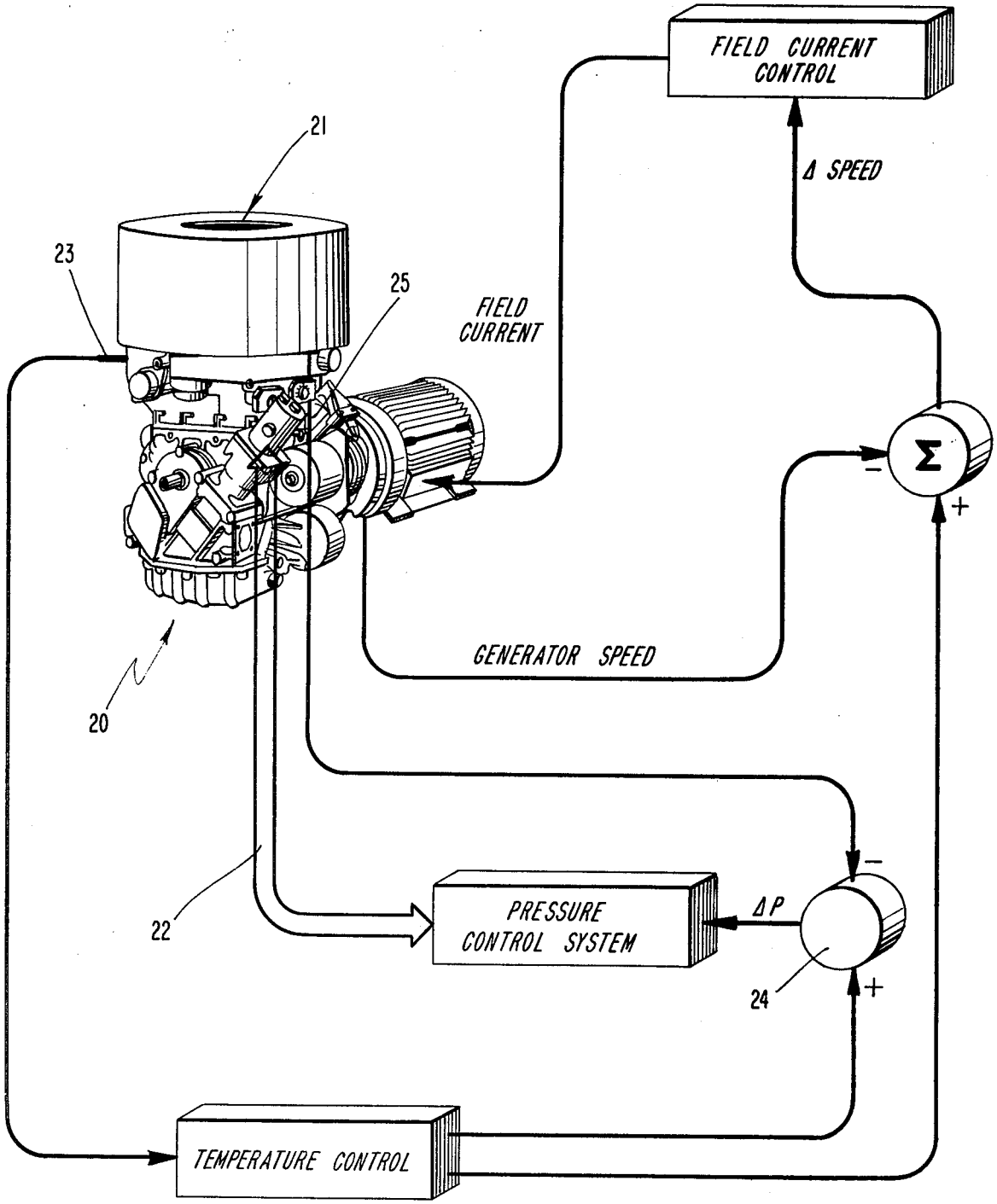
FIG. 5 is a block diagram of a control system for a solar powered hot gas engine adapted to generate electric DC power.

FIG. 5 shows a block diagram of a power control system for a hot gas engine adapted to generate electric DC power. Elements corresponding to those shown in FIG. 2 have corresponding reference numerals.

The pressure control system operates in the same way as that used in the system shown in FIG. 2, but higher outputs are obtainable as higher engine speeds are allowed. Thus the temperature control device primarily governs the engine gas pressure at a certain engine speed. However, when the maximum gas pressure is obtained (at a rather low constant engine speed) the engine speed is increased with increasing solar energy power input. The temperature of the hot gas is kept constant of the whole load range.

Figure 6:
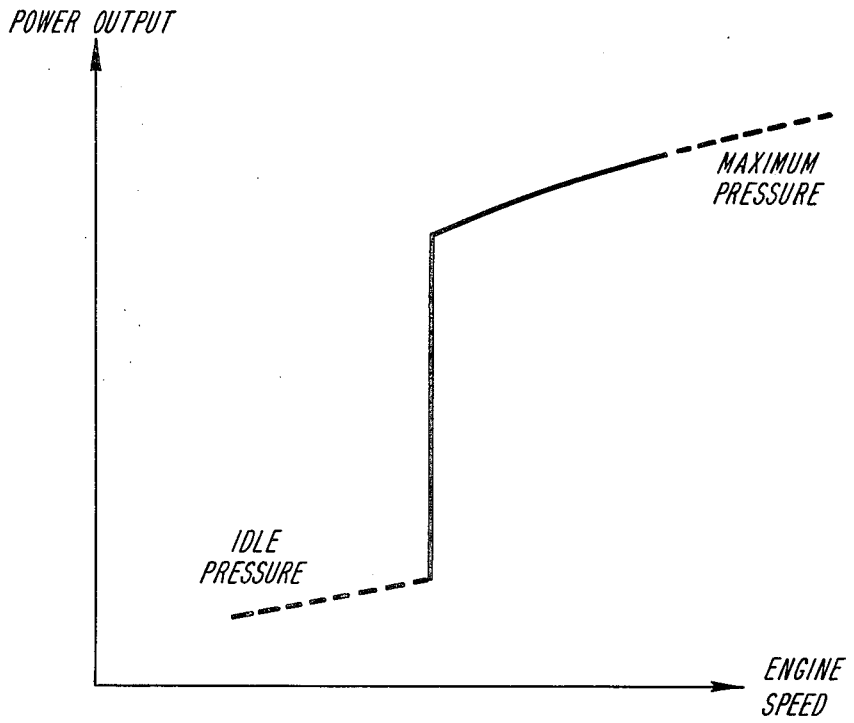
FIG. 6 is a graph of the power output as a function of the engine speed in a plant having the control system of FIG. 5

FIG. 6 shows the power output of a DC producing solar heated hot gas plant. At a rather low constant engine speed the gas pressure is raised sufficiently to keep the hot gas temperature constant at increasing power input and output. As soon as the maximum gas pressure is reached a higher power input and output may be handled at the same hot gas temperature by increasing the engine speed. This is obtained by controlling the generator field current.

Figure 7:
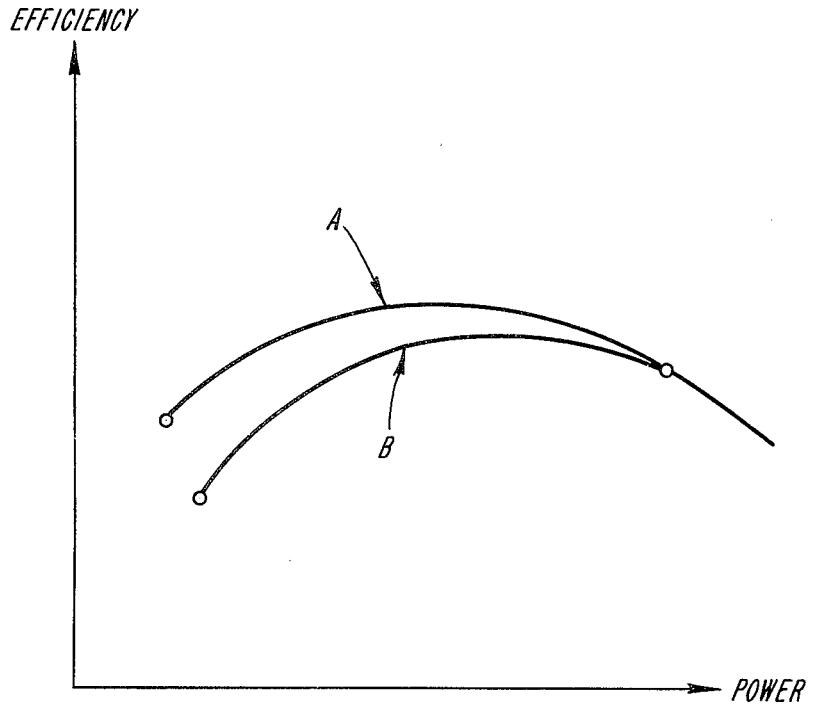
FIG. 7 is a graph of the engine efficiency as a function of the power output.

FIG. 7 illustrates the efficiency of the plant in dependence on the power output. Curve A shows a DC operation while curve B shows an AC operating system.

The above disclosed method for governing the working gas temperature of a solar heated, closed-cycle hot gas engine can also be used to maintain constant working gas temperature at different engine speed levels by varying the gas pressure at each different speed level.

What is claimed is:

1. A method of governing the operation of a solar heated, closed cycle, hot gas engine comprising:

(a) measuring the working gas temperature;

(b) comparing said measured working gas temperature to a predetermined optimum working gas temperature for achieving maximum engine efficiency;

(c) measuring the working gas pressure;

(d) comparing said measured working gas pressure with a predetermined engine idle pressure and with a predetermined engine maximum allowable working gas pressure;

(e) for engine operation below the engine power output range, maintaining the working gas pressure essentially constant and equal to the predetermined idle pressure while the working gas temperature is allowed to increase to the predetermined optimum working gas temperature; and (f) for engine operation in at least one part of the engine power output range, maintaining the working gas temperature essentially constant and equal to the predetermined optimum working gas temperature by varying the working gas pressure, said temperature maintaining step also including the sub-step of holding the engine speed essentially constant during said output power range part, and said temperature maintaining step also including the sub-step of limiting any increase in working gas pressure to a pressure about equal to the maximum allowable working gas pressure.

2. The method of governing the operation of a solar heated, closed cycle, hot gas engine as in claim 1 including the further step of, for operation of power output levels greater than that at the engine conditions of maximum allowable pressure, optimum working gas temperature and said constant speed, increasing or decreasing the engine speed to maintain the working gas at said maximum allowable working gas pressure and said optimum working gas temperature.

3. The method of governing the operation of a solar heated, closed cycle, hot gas engine as in claim 1 wherein, for operation at power output levels greater than that at the engine conditions of maximum allowable working gas pressure, optimum working gas temperature, and said constant speed, said working gas pressure and said speed are maintained constant and said working gas temperature is allowed to increase above said optimum value to a level corresponding to the power output level.

4. The method of governing the operation of a solar heated, closed cycle, hot gas engine as in claim 2 wherein the engine is being used for powering a DC electric power generator having a field current control, and the increasing or decreasing of the engine speed is accomplished by increasing or decreasing the field current of said DC generator.

5. The method of governing the operation of a solar heated, closed cycle, hot gas engine as in claim 1 wherein the engine is used for powering an AC electric power generator and the generator is operatively connected to an existing AC grid to maintain said constant engine speed.

6. The method of governing the operation of a solar heated, closed cycle, hot gas engine as in claim 3 wherein the engine is used for powering an AC electric power generator and the generator is operatively connected to an existing AC grid to maintain said constant engine speed.

7. The method of governing the operation of a solar heated, closed cycle, hot gas engine as in claim 1 wherein at working gas pressures less than the maximum allowable level, the working gas temperature is maintained essentially constant at different engine speed levels, and at each different speed level the temperature maintaining step includes the step of varying the working gas pressure.

* * * * *